US011020958B2

(12) United States Patent
Chretien

(10) Patent No.: US 11,020,958 B2
(45) Date of Patent: Jun. 1, 2021

(54) FOIL REEL MOUNTING DEVICE, SUPPORTING MODULE, STAMPING MACHINE, HANDLING TOOL AND METHOD FOR LOADING AND UNLOADING A REEL OF STAMPING FOIL

(71) Applicant: BOBST MEX SA, Mex (CH)

(72) Inventor: Julien Chretien, Métabief (FR)

(73) Assignee: BOBST MEX SA

( * ) Notice: Subject to any disclaimer, the term of this patent is extended or adjusted under 35 U.S.C. 154(b) by 292 days.

(21) Appl. No.: 15/764,362

(22) PCT Filed: Oct. 14, 2016

(86) PCT No.: PCT/EP2016/025116
§ 371 (c)(1),
(2) Date: Mar. 29, 2018

(87) PCT Pub. No.: WO2017/071816
PCT Pub. Date: May 4, 2017

(65) Prior Publication Data

US 2018/0257366 A1 Sep. 13, 2018

(30) Foreign Application Priority Data

Oct. 28, 2015 (EP) ..... 15020205

(51) Int. Cl.
*B65H 19/12* (2006.01)
*B41F 19/06* (2006.01)

(52) U.S. Cl.
CPC ..... *B41F 19/068* (2013.01); *B65H 19/126* (2013.01); *B41P 2219/21* (2013.01);
(Continued)

(58) Field of Classification Search
CPC ..... B65H 19/126
(Continued)

(56) References Cited

U.S. PATENT DOCUMENTS 4,728,089 A * 3/1988 Barrett ..... B65H 19/126 226/38
7,127,989 B2 * 10/2006 Schaffrath ..... B41F 31/15 101/147

(Continued)

FOREIGN PATENT DOCUMENTS

EP 1 588 968 A1 10/2005
JP H02-95651 A 4/1990
WO WO 2015/000558 A1 1/2015

OTHER PUBLICATIONS

International Search Report dated Feb. 10, 2017 in corresponding PCT International Application No. PCT/EP2016/025116.

(Continued)

*Primary Examiner* — Anthony H Nguyen
(74) *Attorney, Agent, or Firm* — Ostrolenk Faber LLP

(57) ABSTRACT

A foil reel mounting device for supporting a reel of stamping foil in a supporting module. The device includes a support having a recess to receive an axle of the reel of stamping foil. A retaining element mounted on the support and arranged to move between a closed position, in which the retaining element retains the axle of the reel in the recess, and an open position, in which the retaining element releases the axle of the reel from the recess. The retaining element is biased towards the closed position. Also, a supporting module has at least one foil reel mounting device and a stamping machine includes a supporting module or at least one foil reel mounting device. A method for loading and unloading a reel of stamping foil with such at least one foil reel mounting device is also disclosed.

20 Claims, 8 Drawing Sheets

(52) U.S. Cl.
CPC ..... *B41P 2219/42* (2013.01); *B41P 2219/60* (2013.01); *B65H 2301/41306* (2013.01); *B65H 2301/41308* (2013.01)

(58) Field of Classification Search
USPC ..... 101/27
See application file for complete search history.

(56) References Cited

U.S. PATENT DOCUMENTS

| | | | | |
|---|---|---|---|---|
| 2002/0121569 | A1* | 9/2002 | Harris | B65H 23/12 242/417.3 |
| 2004/0118964 | A1* | 6/2004 | Long | B65H 19/1836 242/554.2 |
| 2005/0189449 | A1* | 9/2005 | Bilskie | B65H 19/126 242/559.1 |
| 2007/0029436 | A1* | 2/2007 | Gaines | B32B 41/00 242/599.3 |
| 2008/0229958 | A1* | 9/2008 | Catelli | B31F 1/07 101/479 |
| 2013/0043340 | A1* | 2/2013 | Tenpaku | B65H 19/126 242/598.2 |

OTHER PUBLICATIONS

Written Opinion dated Feb. 10, 2017 in corresponding PCT International Application No. PCT/EP2016/025116.

* cited by examiner

F-F

FOIL REEL MOUNTING DEVICE, SUPPORTING MODULE, STAMPING MACHINE, HANDLING TOOL AND METHOD FOR LOADING AND UNLOADING A REEL OF STAMPING FOIL

CROSS-REFERENCE TO RELATED APPLICATIONS

The present application is a 35 U.S.C. §§ 371 national phase conversion of PCT/EP2016/025116, filed Oct. 14, 2016, which claims priority of European Patent Application No. 15020205.9, filed Oct. 28, 2015, the contents of which are incorporated by reference herein. The PCT International Application was published in the English language.

TECHNICAL FIELD

The present invention relates to a foil reel mounting device configured to support a reel of stamping foil to a supporting module comprising at least one foil reel mounting device and to a stamping machine comprising a supporting module or at least one foil reel mounting device. The invention also relates to a handling tool for an external lifting means, configured to carry a foil reel mounting device. The invention further relates to a method for loading and unloading a reel of stamping foil using such at least one foil reel mounting device and to a method for loading and unloading a foil reel mounting device in a supporting module.

TECHNICAL BACKGROUND

In the field of packaging manufacture, for example packaging intended for the luxury industry, a stamping machine deposits patterns on a sheet-like support by applying pressure. The patterns may include text and/or drawings and most patterns are metallized. They are obtained by a shape stamping. The patterns are supplied from portions of a film of one or more stamping foils.

In the stamping machine, the sheet elements are retrieved from a stack located upstream, grasped by a carrier, and taken successively in a stamping platen-type press having a platen supporting the stamping shape. A stamping die is mounted on the fixed upper tool of the press. A counterpart shape stamping die is mounted on the movable lower tool of the press. In a hot stamping, known as hot foil stamping, the stamping die is heated. Metallized stamping foils are brought between the scrolling plane of advancement of the sheet elements and the upper tool.

In a vertical rising movement, the movable lower tool presses the stamping foil against each sheet element between the stamping dies to deposit portions of the film. After the film deposition, the lower tool moves down and the now stamped sheet element is released by the gripper bar onto a stack to free a place for a new following sheet element.

At the same time, the stamping foil is moved so that a new film surface is brought into correspondence with the stamping die.

Each stamping foil is configured in the form of a rotatably mounted reel which is unwound by an advance shaft or by a reeling machine which directly pulls the foil. Stamping foil reels are stored in a support module, which support the reels and feed one or more foils to the machine. In practice, the advance shaft is turns at a variable speed as the foil advances sequentially into the stamping press. This is unlike a reeling machine that, in production, draws continuously on the reel.

The reels are generally quite heavy and costly due to the material used for stamping which may typically be gold or other precious metallic materials. Due to the weight of a reel, which can be up to 300 kg, the reels are not easy to install. There is an additional risk of damaging the reels when mounting them into the module. This is not economically acceptable, considering the high cost of the reels.

SUMMARY OF THE INVENTION

It is therefore an object of the present invention to provide simple, safe and efficient means for loading and unloading such reels.

To this end, one subject of the invention is a foil reel mounting device configured to support a reel of stamping foil in a supporting module. The mounting device is configured to be fixed to the supporting module. That device comprises a support having a recess configured to receive an axle of a reel of stamping foil. The device further comprises a retaining element mounted on the support and arranged to move between a closed position, in which the retaining element retains the axle of the reel in the recess, and an open position in which the retaining element releases the axle of the reel from the recess. The retaining element is biased towards the closed position.

The retaining element retaining the axle of the reel in the recess in the closed position ensures that the reel remains well positioned in the recess, particularly despite vibrations that may occur at the foil reel mounting device during operation. In addition, the bias of the retaining element towards the closed position ensures avoiding starting operations on the reel while the retaining element is forgotten in the open position.

According to one or more features of the foil reel mounting device, taken alone or in combination, the retaining element has a cam surface configured to cooperate with the axle of the reel to displace the retaining element from the closed position to the open position, which releases access of the recess to the passage of the axle of the reel,

- the cam surface has a general shape of a ramp,
- the retaining element is biased towards the closed position by gravity,
- the access to the recess faces downwards, the retaining element has a general shape of "C" with a closing end that obstructs access to the recess when the recess is in the closed position. The rotational axis of the retaining element being disposed in an opposite end,
- a bearing capable of supporting the axle of the reel is formed in a closing end of the retaining element which is configured to close the recess in the closed position,
- the foil reel mounting device comprises at least one holding member operable to move between an unlocked position and a locked position, wherein the holding member cooperates with the retaining element to prevent the retaining element moving to the closed position, and the holding member being biased toward the unlocked position,
- the retaining element may have an intermediate position between the open position and the closed position, at which the retaining element partially releases access to the recess, and leaves an external portion of the closing end of the retaining element in the access path of the axle of the reel; the external portion of the closing end of the retaining element is configured to cooperate with the axle of the reel in the intermediate position to move the retaining element in the open position, disengaging the holding member, the holding member is biased towards the closed position by gravity, the holding member is a holding lever pivotally mounted on the retaining element and arranged to move between an unlocked position and a locked position, the holding lever has a first arm in contact with a complementary surface of the retaining element in the locked position, the retaining element has a clearance configured to allow an operator to manually pinch the end of the first arm against a complementary surface of the retaining element, the holding lever has a second arm carrying a beak configured to cooperate with a catch of the support in the locked position, the holding member is a pin sliding in an opening of the support and arranged to move between an unlocked position and a locked position, the sliding pin is configured to cooperate with a hook of an additional cam surface of the retaining element in the locked position, the foil reel mounting device comprises at least one reel rotation braking means configured to cooperate with a complementary braking means supported by the reel, the reel rotation braking means comprises an electromagnetic brake, the electromagnetic brake comprises a gear train comprising a first gear secured to a flange of the reel coaxially to the axle of the reel and a last gear cooperating with an electromagnetic element.

Another object of the invention is a supporting module configured to support at least one reel of stamping foil, comprising at least one cross-member on which at least one foil reel mounting device is mounted.

Another object of the present invention is a stamping machine, comprising at least one foil reel mounting device as described or a supporting module as described.

Another object of the present invention is a handling tool for an external lifting means, configured for carrying a foil reel mounting device, wherein the handling tool comprises a head having a semi-cylindrical shape configured to be received in the recess of the support of a foil reel mounting device such as described, the head having also a retaining hollow configured to cooperate with an external portion of the closing end of the retaining element in an intermediate position to retain the handling tool in the support.

Another object of the present invention is a handling tool for an external lifting means, configured for carrying a foil reel mounting device, wherein the handling tool comprises a head configured to be received in the recess of the support of a foil reel mounting device such as described, the head having a retaining means adapted to cooperate to retain the handling tool in the support.

The handling tool may comprise a trunk part presenting a ramp able to cooperate with a guide wall of the support in the intermediate position to prevent relative movement between the handling tool and the support when the handling tool is engaged in the support.

Another object of the present invention is a method for loading and unloading a reel of stamping foil in at least one foil reel mounting device as described, wherein the pushing of an axle of a reel of stamping foil against the retaining element moves the retaining element into the open position and the introduction of the axle of the reel in the recess of the support moves the retaining element in the closed position.

According to one aspect of the method, to unload the reel, the retaining element is manually moved and a holding member is manually engaged to prevent the moving of the retaining element into the closed position.

According another aspect of the method, the withdrawal of the axle of the reel from the recess disengages the holding member.

Another object of this invention is a method for loading and unloading a foil reel mounting device in a supporting module with a handling tool as described, wherein the pushing of head of the handling tool against the retaining element moves the retaining element into the open position and the introduction of the head in the recess of the support releases the retaining element under the head.

BRIEF DESCRIPTION OF THE DRAWINGS

Further advantages and features will become apparent from reading the description of the following figures, which are given by way of no limiting example.

DESCRIPTION OF EMBODIMENTS

Figure 1:
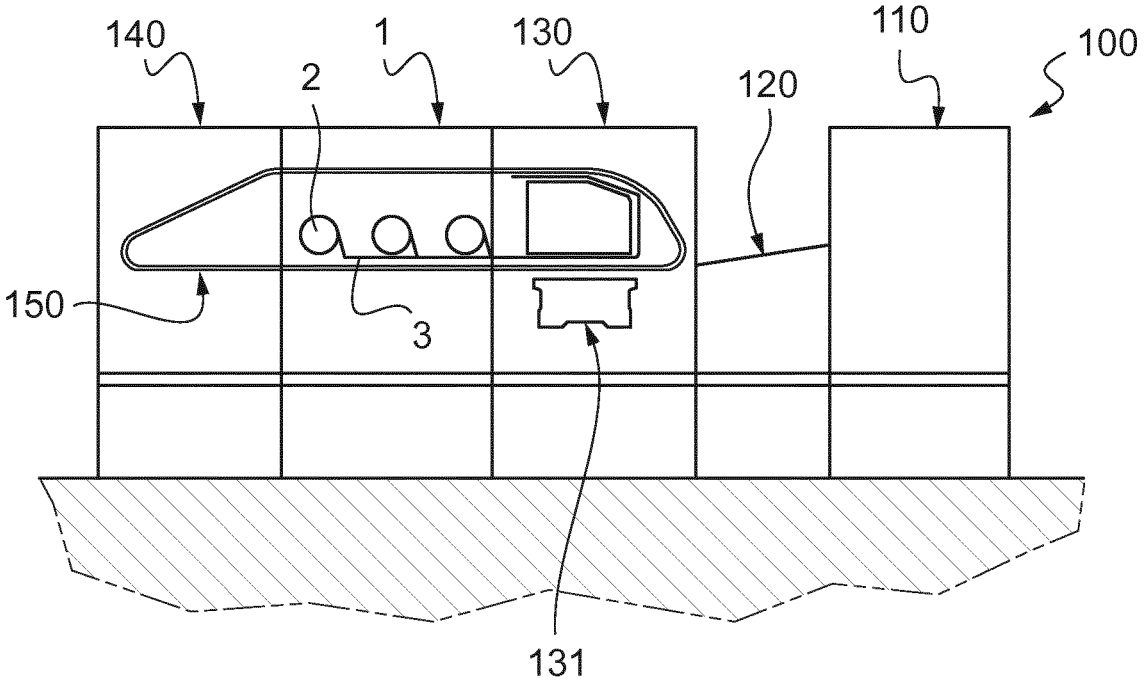
FIG. 1 illustrates a stamping printing machine in which a supporting module is integrated.

For reasons of clarity, the same elements have been given identical reference numerals. Similarly, only the elements essential to the understanding of the invention have been illustrated, in a schematic manner and without being to scale.

Figure 3:
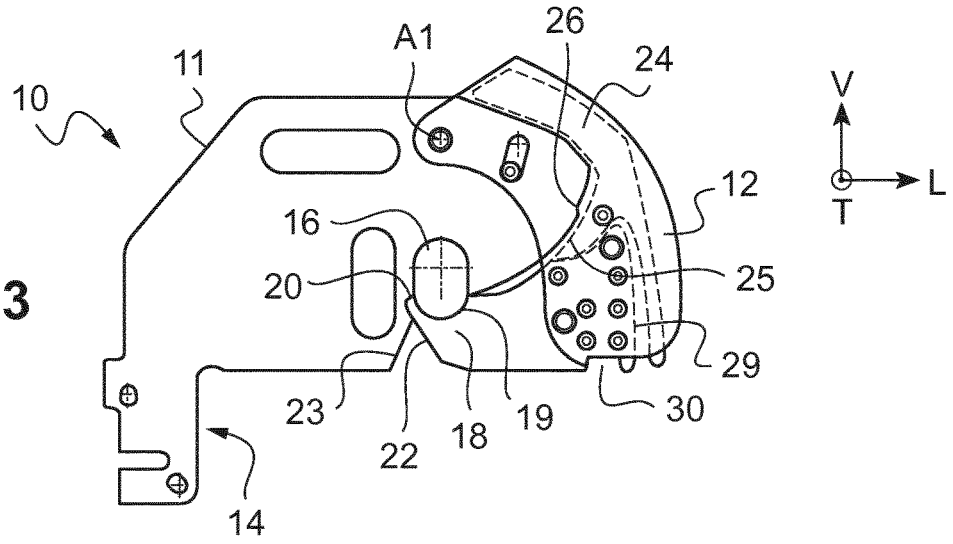
FIG. 3 shows a schematic view of a foil reel mounting device according to a first embodiment with the retaining element in the closed position.

The longitudinal, vertical and transverse directions are indicated in FIG. 3 by the orthogonal system (L, V, T). The transverse direction T is the direction perpendicular to the longitudinal direction of travel L of a foil. The horizontal plane corresponds to the plane (L, T).

FIG. 1 illustrates a stamping printing machine 100 for use in the packaging, for example cardboard packaging, notably intended for the luxury goods industry to be personalized.

A stamping machine 100 conventionally comprises a plurality of workstations 110, 120, 130, 1, 140 which are juxtaposed in order to form a unitary assembly which is capable of processing a succession of flat sheet-like elements. A feeder 110 is configured to supply the machine sheet by sheet, a feeder table 120 on which the sheets are placed in layers before being positioned precisely and individually, a stamping station 130 which uses a platen press 131 in order to deposit on each sheet, for example by hot stamping, some metalized coating from a plurality of stamping foils 3, a supporting module 1 for supplying the stamping machine 100 with stamping foils 3 which are stored in the form of reels 2, and a delivery station 140 for restacking the previously processed sheets. Transporting means 150 individually displace each sheet from the output of the feeder table 120 to the delivery station 140, via the stamping station 130.

The supporting module 1 can be internal to the stamping machine 100 (FIG. 1) or external.

Figure 2:
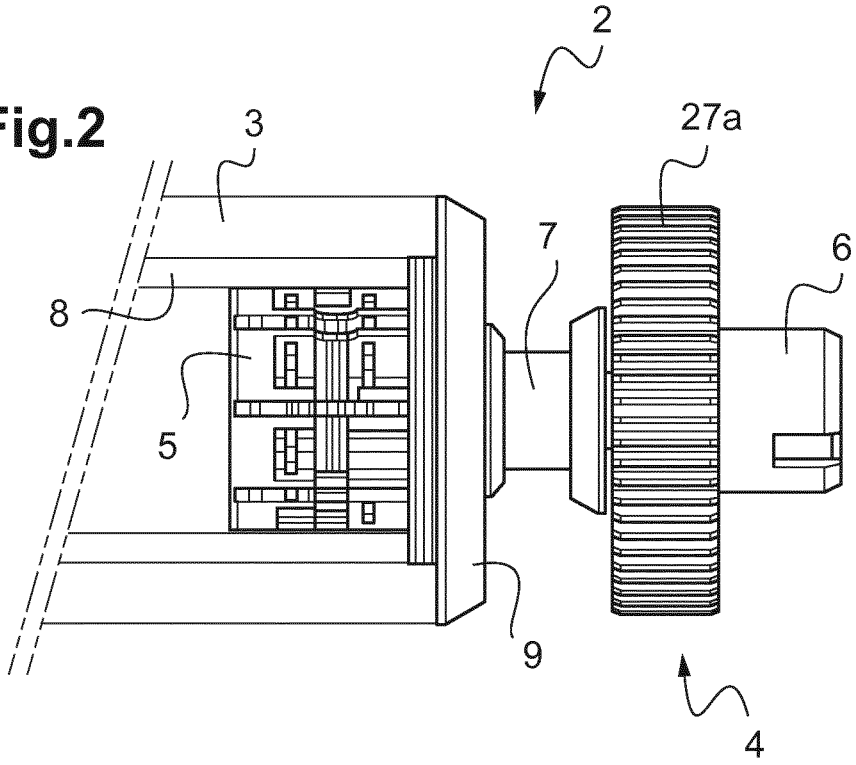
FIG. 2 represents an end of a reel of stamping foil provided with a flange.

As it can be seen in FIG. 2, the reel 2 supports stamping foil 3 wound on a roller 8, for example a cardboard-based roller 8. The stamping foil 3 supports a film for example of colored and/or metallized materials, such as gold or aluminium.

The reels 2 can be quite heavy and may weigh up to 300 kg.

The reel 2 is provided with at least one flange 4 and preferably with a pair of side flanges 4, with a flange 4 being mounted on each side of the roller 8 supporting the stamping foil 3.

The flange 4 has an expansive hub 5 on one side (inner side of the roller 8) adapted to extend within the roller 8, to secure the flange 4 and has a stop 6 on the other side (outer side). A ring 9 is used to position the roller 8 in abutment while expanding the expansive hub 5. The flange 4 has an axle 7 interposed between the expansive hub 5 and the abutment 6. Thus, a pair of side flanges 4 can be mounted on each roller 8, with the flanges 4 being locked therein due to expansive hub 5. The reel 2 can thus be unwound, rotating around the axle 7.

The reel 2 is supported by its axle 7 by means of at least one foil reel mounting device 10 of the supporting module 1 allowing the reel to be unwound, for example by means of an advance shaft and pressing rollers or a reeling machine to supply the stamping machine 100.

The foil reel mounting device 10 is adapted to be fixed to the supporting module 1. For example, the supporting module 1 comprises at least one horizontal cross-member 13 on which is mounted at least one foil reel mounting device 10. It may be provided with two foil reel mounting devices 10, one for each side of a reel 2 provided with two side flanges 4 to avoid a cantilever, especially for massive reels 2.

Several pairs of supports devices 10 may be mounted along the same cross-member 13 (FIGS. 7-13) for smaller reels 2. The majority of the patterns deposited on packaging may be made from stamping foil of low width, generally not exceeding 30 cm. But it is sometimes necessary to use stamping foil having larger width, typically in the order of 50 cm to 140 cm. A plurality of narrower foil arranged side by side and whose total cumulated width reaches this order of size can also be used.

A supporting module 1 may also comprise several cross-members 13, for example three, coplanar and equally spaced.

The cross-members 13 are for example located in a workspace which is arranged in the upper portion of the supporting module 1. Furthermore, the lower portion of the module 1 itself comprises a free space which is laterally accessible from the outside of the module 1 and communicates with the workspace via the top of the free space, in particular for receiving an external lifting means 200, (FIGS. 7-13) such as a forklift. The external lifting means 200 can thus on the one hand, transport each reel 2 during its introduction into the free space in a substantially transverse direction, and on the other hand, transfer each reel 2 from the free space to the workspace in a substantially vertical direction.

FIGS. 3 to 13 illustrate a first embodiment of a foil reel mounting device 10.

The foil reel mounting device 10 comprises a support 11 and a retaining element 12.

The support 11 has a recess 16 for receiving an axle 7 of a reel 2.

Figure 7:
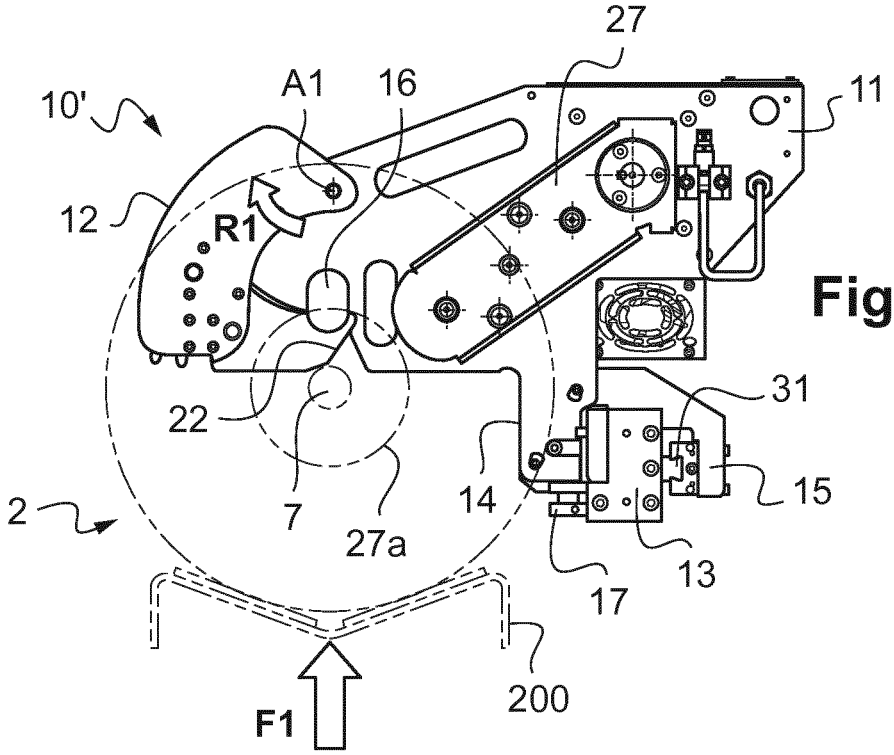
FIG. 7 shows a schematic side view of the foil reel mounting device of FIG. 6, mounted on a cross-member, with the retaining element in the closed position and a reel ready to be loaded, supported by a forklift, FIG. 8 corresponds to a view of the next step of the loading with respect to the step shown in FIG. 7, of the loading of the reel in the foil reel mounting device, with the retaining element in the open position.

According to one embodiment better seen in FIG. 7, the support 11, for example made of a metallic plate, comprises a base 14 fixed to a bracket 15 supporting a slide 31. The slide 31 cooperates with a rail of the cross-member 13, for example by a dovetail. A position locking means 17, for example a clamping screw, is used to lock the bracket 15 in position by tightening against the cross-member 13. The support 11 can thus slide along the cross-member 13 by means of the slide 31 and being locked on the cross-member 13 in a selected position by the position locking means 17 for use. In the released state, the supports 11 can move laterally on the cross-member 13 to be adapted to the size of the reel 2.

The retaining element 12 is mounted on the support 11 and arranged to move between a closed position (FIG. 3) to block the axle 7 of the reel 2 retained in the recess 16, and an open position (FIG. 5) in which the retaining element 12 is arranged to release the axle 7 of the reel 2 from the recess 16.

The retaining element 12 is biased towards the closed position, for example by gravity or by spring loading.

Retaining the axle 7 of the reel 2 in the recess 16 in the closed position by the retaining element 12 ensures that the reel 2 remains well positioned in the recess 16, in particular despite the vibrations that may occur on the foil reel mounting device 10 during operation. In addition, the bias of the retaining element 12 towards the closed position ensures avoiding starting operations on the reel 2 while having forgotten the retaining element 12 in the open position.

The retaining element 12 can be a lever pivotally mounted on the support 11 around a rotational axis A1. According to another embodiment, the retaining element may be a sliding element adapted to be translated between the closed position and the open position (not shown).

Figure 4:
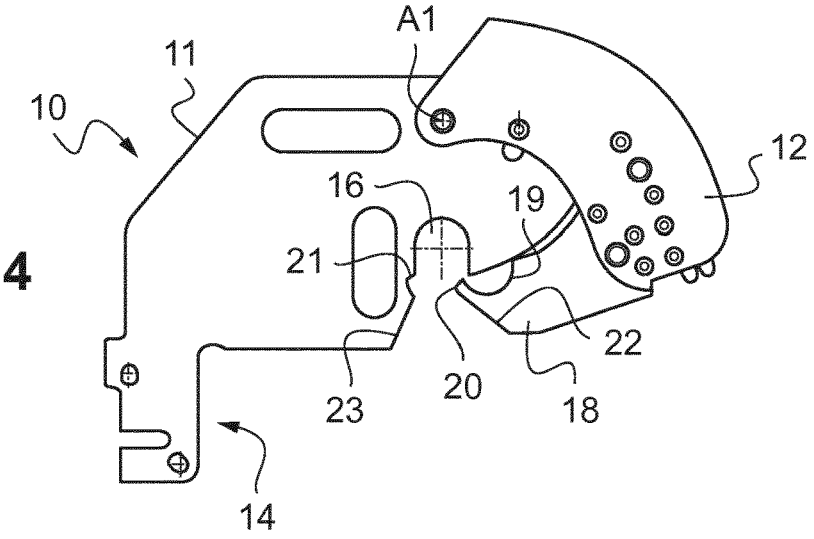
FIG. 4 shows the foil reel mounting device of FIG. 3 with the retaining element in its intermediate position.
Figure 5:
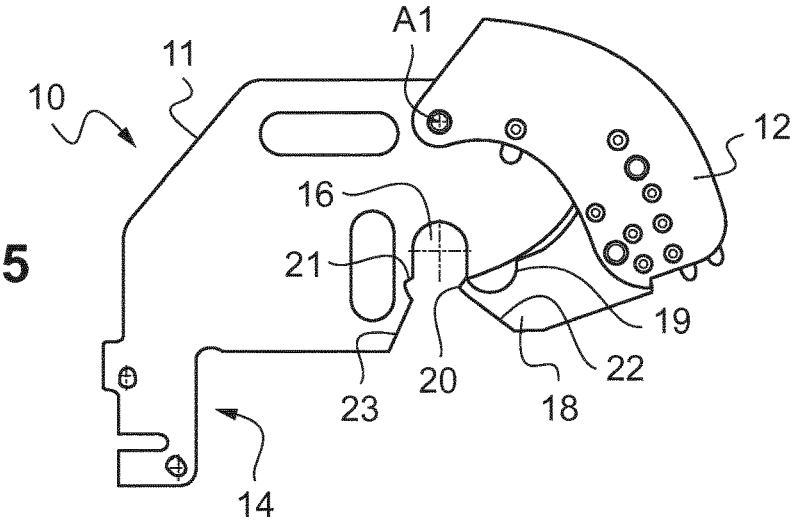
FIG. 5 shows the foil reel mounting device of FIG. 3 with the retaining element in the open position.

According to an exemplary embodiment visible in FIGS. 3 to 5 for a retaining element 12 pivotally mounted and biased towards the closed position by gravity, access to the recess 16 faces downwards and the retaining element 12 has a general shape of "C" of which a closing end 18 completely obstructs the access of the recess 16 in the closed position.

The rotational axis A1 of the retaining element 12 is disposed in an opposite end, so that the retaining element 12 weight tends to pivot the closing end 18 downwardly to the closed position. Biasing by gravity presents the advantage of being easier to implement in the small space available around the reel 2.

A bearing 19 capable of supporting the axle 7 of the reel 2 is formed in the closing end 18 of the retaining element 12. The opening of the bearing 19 faces upwards in the closed position, facing the opening of the recess 16.

The extreme portion 20 of the closing end 18 is shaped to engage in a complementary transverse groove 21 of the recess 16 in the closed position. The recess 16 closed by the bearing 19 forms an oblong shape hole dimensioned so that the axle 7 of the reel 2 is positioned away from the bearing 19 when it is in abutment at the top of the recess 16.

The retaining element 12 also has a cam surface 22 adapted to cooperate with the axle 7 of the reel 2 to displace the retaining element 12 from the closed position to the open position, releasing the access of the recess 16 for the passage of the axle 7 of the reel 2.

The active surface 22 is located on an edge of the retaining element 12, to the outside of the recess 16 and in the case wherein the retaining element 12 is biased towards the closed position by gravity, below the recess 16. Thus, the vertical thrust of the axle 7 of the reel 2 against the cam surface 22 automatically clears the access of the recess 16, allowing the passage of the axle 7 of the reel 2 in the recess 16.

The cam surface 22 has for example a general shape of a ramp.

It may further be provided that the support 11 has a guide wall 23 capable of guiding the axle 7 of the reel 2 toward the cam surface 22. The guide wall 23 has for example a general shape of a ramp. In the closed position, the guide wall 23 and the cam surface 22 form a funnel in "V" shape.

According to an exemplary embodiment, the foil reel mounting device 10 comprises at least one holding member arranged to move between an unlocked position and a locked position. In the locked position, the holding member cooperates with the retaining element 12 to prevent the moving of the retaining element 12 in the closed position. The holding member is biased towards the unlocked position, for example by gravity or by spring loading.

The retaining element 12 can also have an intermediate position (FIG. 4) between the open position and the closed position, wherein the retaining element 12 releases partially the access to the recess 16, leaving an external portion 20 of the closing end 18 of the retaining element 12 in the path access of the axle 7 of the reel 2.

The external portion 20 of the closing end 18 of the retaining element 12 is adapted to cooperate with the axle 7 of the reel 2 in the intermediate position to move the retaining element 12 in the open position, disengaging the holding member.

In the first embodiment, the holding member is a holding lever 24 (dotted lines in FIG. 3) pivotally mounted on the retaining element 12 about a rotational axis A2 and arranged to move between an unlocked position (FIGS. 3 and 5) and a locked position (FIG. 4).

Figure 6:
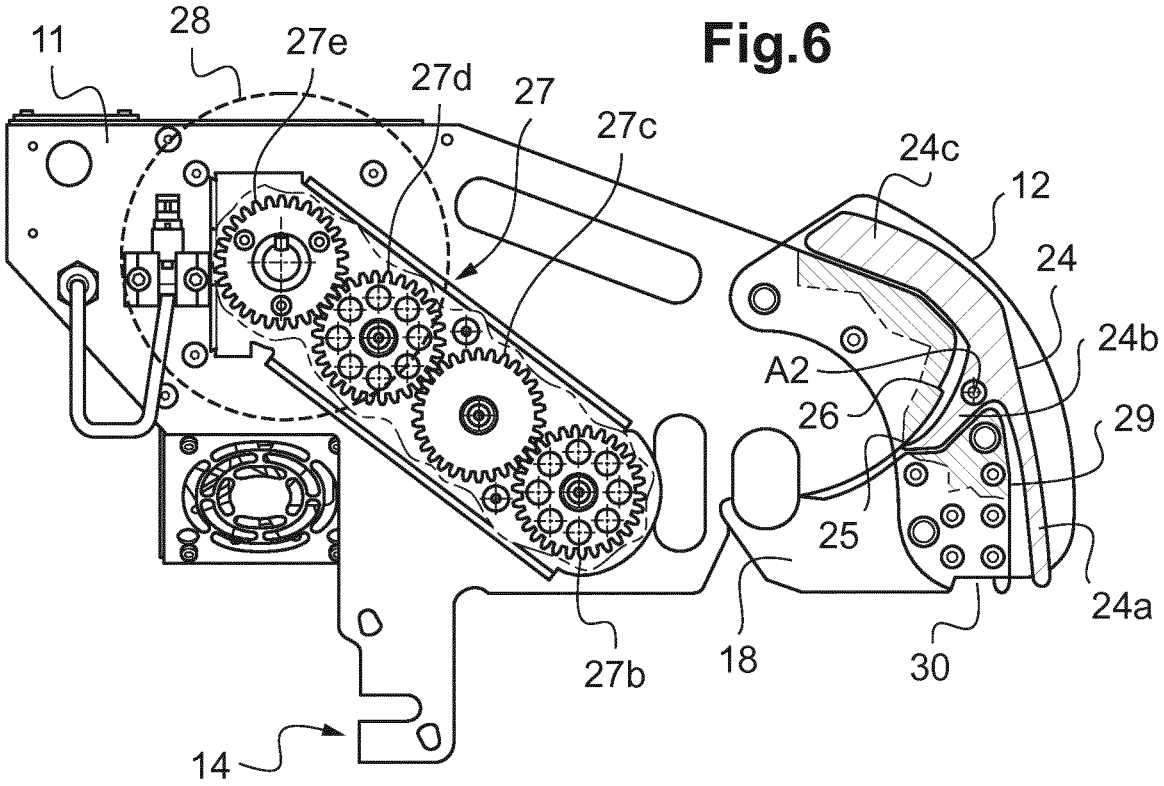
FIG. 6 shows a schematic side view of another foil reel mounting device, with the retaining element in the closed position.

As seen in the embodiment of FIG. 6, the holding lever 24 is in a single piece has, for example first, second and third arms 24*a*, 24*b*, 24*c* pivoting about the rotational axis A2 which is located substantially at the base of the three arms 24*a*, 24*b*, 24*c*.

The first arm 24*a* has for example the shape of a rod. In the locked position, the first arm 24*a* is in contact with a complementary surface 29 of the retaining element 12. In the unlocked position, the first arm 24*a* is away from the complementary surface 29.

The retaining element 12 may have a clearance 30 allowing the operator to grasp the retaining element 12 to raise it into the intermediate position and to pinch the end of the first arm 24*a* against the retaining element 12, for example between his thumb (in the clearance 30) and forefinger (against the first arm 24*a*) to rotate the holding lever 24 in the locked position.

The second arm 24*b* presents a beak 25 configured to cooperate with a catch 26 of the support 11 in the locked position, preventing pivoting of the retaining element 12 toward the closed position.

The third arm 24*c* is configured to bias the holding lever 24 towards the unlocked position. In this case, the third arm 24*c* has a shape and a mass adapted to urge the holding lever 24 in the unlocked position by gravity. Biasing by gravity presents the advantage of being easier to implement in the small space available around the reel 2.

According to a simple embodiment, the holding lever 24 is, for example sandwiched between two first plates of the retaining element 12 fixed to a third plate of the retaining element 12 carrying the closing end 18. The holding lever 24 can thus be hidden and protected by the two first plates.

According to an exemplary embodiment, the foil reel mounting device 10 comprises at least one reel rotation braking means adapted to cooperate with a complementary braking means supported by the reel 2. The braking torque can be in the order of 20 N/m for example. One reel rotation braking means can be provided for each reel 2 or two reel rotation braking means can be provided on each side of a reel 2. The reel rotation braking means allows ensuring optimal tension band to follow acceleration, deceleration and delays that may occur, particularly if the advance of the stamping foil 3 is sequenced.

The reel rotation braking means may include a disc brake or a brake pad rubbing.

The disc brake comprises at least one brake calliper acting on a brake disc attached to one of the flanges of the reel (not shown).

According to another example, the reel rotation braking means comprises an electromagnetic brake.

The electromagnetic brake includes for example an electromagnetic element such as a magnetic powder brake 28 (shown schematically in dashed lines in FIG. 6).

In a known manner, and according to an exemplary embodiment, the magnetic powder brake 28 includes an input shaft having a cavity containing magnetic powder and a housing comprising a coil surrounding the cavity with a space between. When a current is applied to the coil, the magnetic field lines connect the input shaft to the housing. The resistant torque increases with increasing current. When the power is off, the input shaft can rotate freely.

The input shaft of the magnetic powder brake 28 is mechanically connected to a flange 4 of the reel 2 by any means, such as by means of belts, gearing or chains.

According to an embodiment partly visible in FIGS. 5 and 6, the electromagnetic brake comprises a gear train 27 meshing with each other. The gear train 27 comprises at least two gears, for example five, a first gear 27*a* is secured to a flange 4 of the reel 2 coaxially to the axle 7 of the reel 2 (FIG. 2) and the other gears 27*b*, 27*c*, 27*d*, 27*e* are supported by the support 11. The last gear 27*e* is secured with the input shaft of the magnetic powder brake 28. The gear train 27 allows deporting the magnetic powder brake 28 from the axle 7 of the reel 2 and/or allows providing a reduction.

We will now describe an example of operation of the foil reel mounting device 10 with reference to FIGS. 7 to 13.

It is considered that the foil reel mounting device 10' is initially in the closed position, without reel and that it is desired to load a reel 2 placed on a forklift 200 equipped with a reel holder having a "V" shape (FIG. 7). We will describe the method for loading and unloading a reel 2 of stamping foil 3 in a single foil reel mounting device 10', while the supporting module 1 may comprise two foil reel mounting devices 10' operating simultaneously in the same manner.

The forklift 200 placed under the foil reel mounting device(s) 10' begins to raise vertically the reel 2 (arrow F1).

The axle 7 of the reel 2 pushes against the bottom of the ramp of the cam surface 22 of the retaining element 12, raising up the retaining element 12 toward the open position gradually while the axle 7 progressing along the ramp, releasing at the same time the access to the recess 16 (arrow R1). The moving of the reel 2 against the retaining element 12 pivots the retaining element 12 in the open position.

Figure 8:
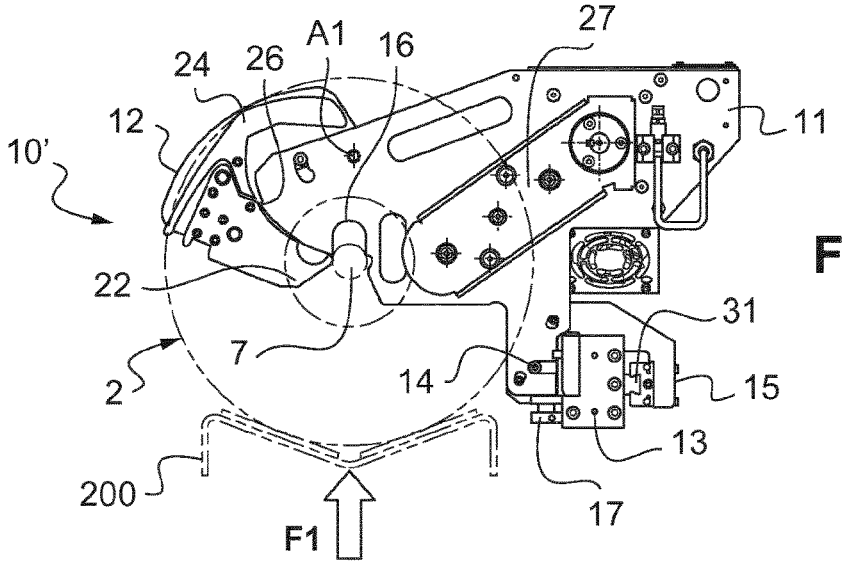

Once the axle 7 of the reel 2 enters the recess 16, the axle 7 of the reel 2 disengages from the cam surface 22 of the retaining element 12 (FIG. 8).

The first gear 27*a* of the brake means supported by the reel 2 starts to mesh with the second gear 27*b* of the gear train 27 supported by the support 11.

Figure 9:
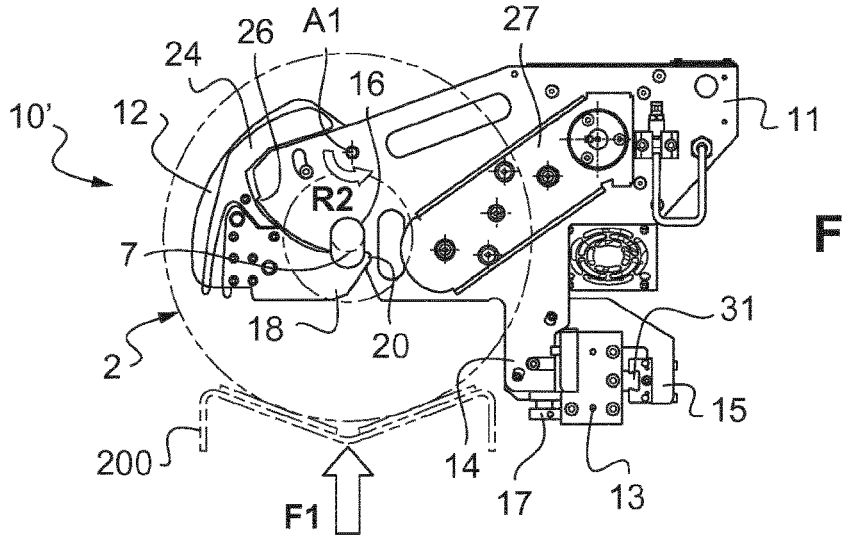
FIG. 9 shows a view of the next step of the loading of the reel with the retaining element in the closed position and the reel in high position in the recess of the foil reel mounting device.

The retaining element 12 which is no longer retained by the axle 7 of the reel 2 rotates in the closed position under the effect of gravity, blocking the axle 7 of the reel 2 in the recess 16 (arrow R2, FIG. 9). Thus, the introduction of the axle 7 of the reel 2 in the recess 16 pivots the retaining element 12 in the closed position.

Then, the axle 7 of the reel 2 abuts the top of the recess 16. The external portion 20 of the closing end 18 of retaining element 12 engages in the complementary transverse groove 21 of the recess 16.

Figure 10:
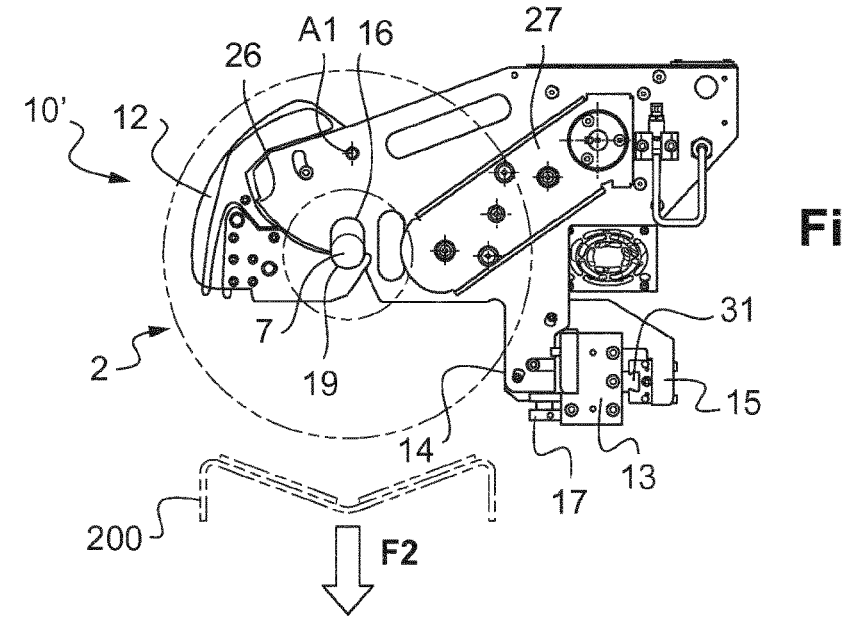
FIG. 10 shows a view of the next step of the loading of the reel, with the retaining element in the closed position and the reel in working position.
Figure 11:
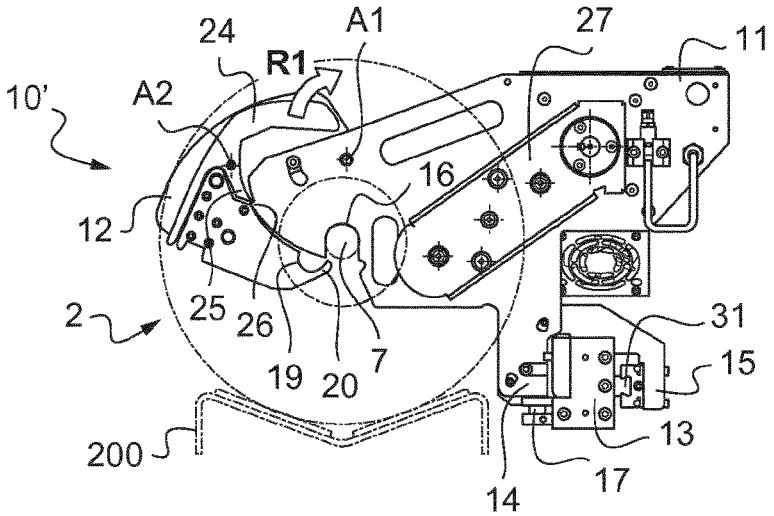
FIG. 11 shows a view of the foil reel mounting device of FIG. 10, with the retaining element in the intermediate position for the unloading of the reel.

The forklift 200 can descend (arrow F2, FIG. 10). The axle 7 of the reel 2 which is no longer retained by the forklift 200 descends in the recess 16 to abut the bearing 19 of the closing end 18 of the retaining element 12. The first gear 27*a* supported by the reel 2 meshes with the second gear 27*b* of the gear train 27 supported by the support 11. The reel 2 supported by the bearing 19 is then in the working position and can be unwound for the stamping operation.

At the end of the operation, when the operator wishes to unload the reel 2, he sets the forklift 200 under the reel 2 and raises the reel 2 so that the axle 7 of the reel 2 gets positioned in the upper position in the recess 16, away from the bearing 19.

Then, the operator manually pivots the retaining element 12 in the intermediate position (R1 arrow, FIG. 11), partly freeing access to the recess 16, the access path to the recess 16 is partially obstructed by external portion 20 of the closing end 18.

Then, almost simultaneously, the operator manually pivots the holding lever 24 by pinching the first arm 24*a* against the retaining element 12. The holding lever 24 that was previously in the unlocked position pivots into the locked position wherein the beak 25 of the holding lever 24 engages the catch 26 of the support 11. In this locked position, the holding lever 24 prevents the retaining element 12 to pivot to the closed position.

The tilting of the retaining element 12 in intermediate position and the holding lever 24 in the locked position requires two manual interventions of the operator. These interventions allow adding a level of security, ensuring that the opening command is voluntary. Furthermore, both manual operations can be carried out almost simultaneously with only one hand.

Figure 12:
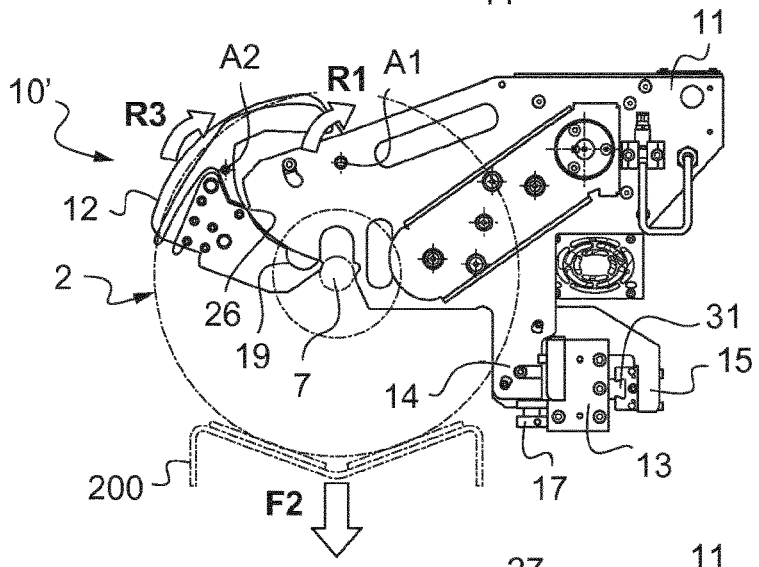
FIG. 12 shows a view of the next step of the unloading of the reel, with the retaining element in the open position.
Figure 13:
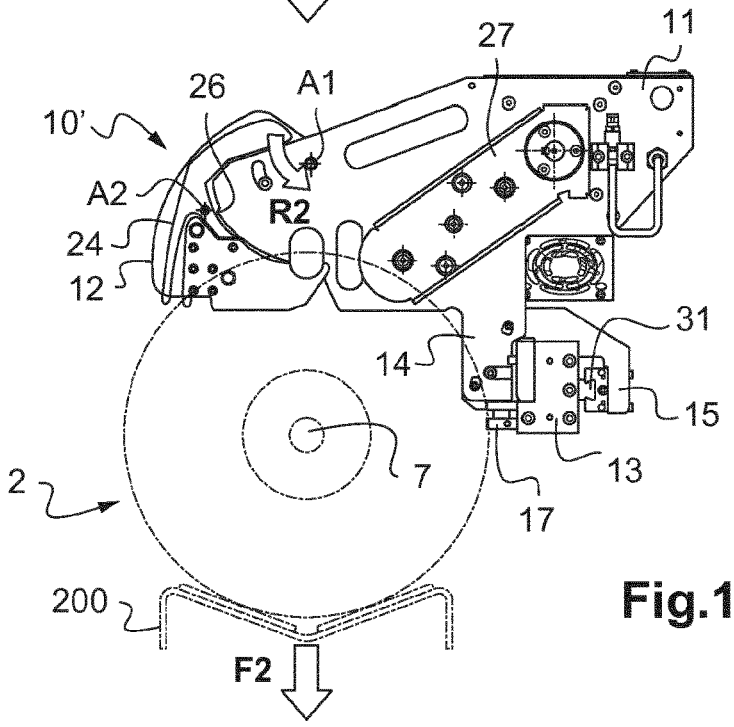
FIG. 13 shows a view of the next step of the unloading of the reel, unloaded with the retaining element in the closed position.

Then, the forklift 200 drops the reel 2 (arrow F2, FIG. 12). The axle 7 of the reel 2 then pushes the external portion 20 of the closing end 18, making the retaining element 12 pivoting in the open position (arrow R1).

The pivoting of the retaining element 12 releases the beak 25 of the catch 26 which, urged by gravity, pivots the holding lever 24 into the unlocked position (arrow R3). Thus, the withdrawal of the axle 7 of the reel 2 from the recess 16 disengages the holding lever 24.

The forklift 200 continues the descent of the reel 2 (arrow F2, FIG. 12).

The retaining element 12 which is no longer retained by the holding lever 24 pivots in the closing position (arrow R2).

Figure 14:
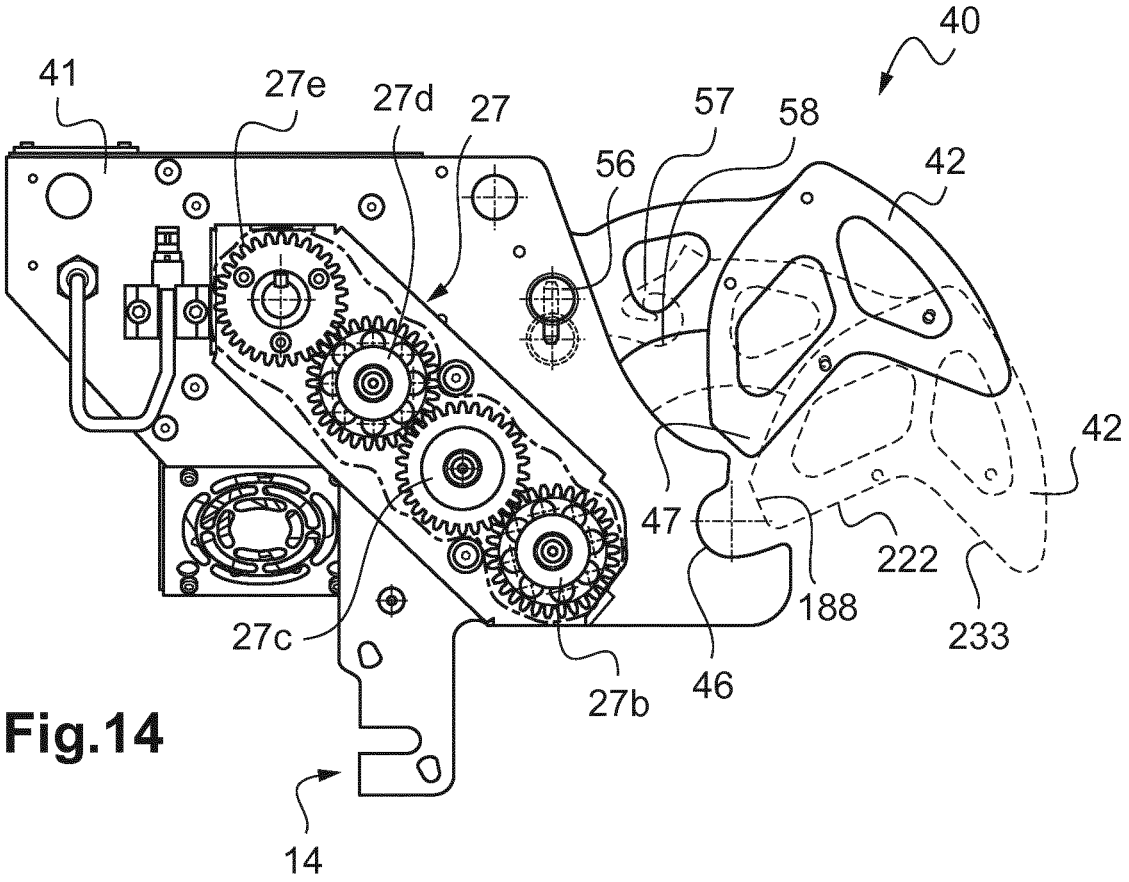
FIG. 14 shows a schematic side view of a foil reel mounting device according to a second embodiment mounted on a cross-member, representing in a continuous line, a retaining element in the open position and in dotted lines, the retaining element in the closed position.
Figure 15:
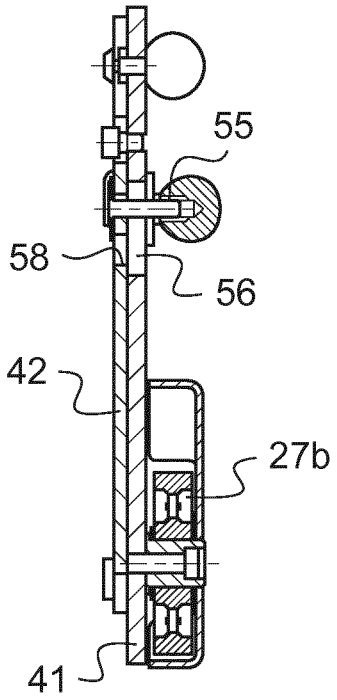
FIG. 15 shows the foil reel mounting device of FIG. 14, in F-F cross-section.

FIGS. 14 and 15 illustrate a second embodiment of the foil reel mounting device 40.

As in the first embodiment, the foil reel mounting device 40 comprises a support 41 and a retaining element 42.

The support 41 also has a recess 46 configured to receive an axle 7 of a reel 2.

The retaining element 42 is mounted on the support 41 and arranged to move between a closed position (dotted line in FIG. 14) in which the retaining element 42 is arranged to retain the axle 7 of the reel 2 in the recess 46, and an open position (in continuous line) in which the retaining element 42 is arranged to release the axle 7 of the reel 2 from the recess 46.

In this embodiment, the retaining element 42 is a lever pivotally mounted on the support 41 and biased by gravity into the closed position.

In this embodiment, the access to the recess 46 is inclined and has a bearing form for supporting the axle 7 of the reel 2 when rotating.

A first foil reel mounting device 40 can be provided on a first side of a reel 2 and a second foil reel mounting device 40 on a second side of the reel 2, or nothing, or a simple support 41 without retaining element on the second side of the reel 2.

The retaining element 42 has an arm and a head carrying a closing end 188.

The head of the retaining element 42 presents a cam surface 222 configured to cooperate with the axle 7 of the reel 2 to displace the retaining element 42 from the closed position to the open position, releasing access to the recess 46 for the passage of the axle 7 of the reel 2.

The cam surface 222 has, for example, a general shape of a ramp.

The head of the retaining element 42 may have a guide wall 233 configured to guide the axle 7 of the reel 2 toward the cam surface 222. The guide wall 233 has for example a general shape of a ramp. The guide wall 233 and the cam surface 222 form a funnel having a "V" shape, located on the head of the retaining element 42. The funnel is open downwardly in the closed position in this case.

Thus, the vertical thrust of the axle 7 of the reel 2 against the cam surface 222 automatically clears the access to the recess 46, allowing the passage of the axle 7 of the reel 2 in the recess 46.

The retaining element 42 can also have an intermediate position (not shown) between the open position and the closed position, wherein the retaining element 42 releases partially the access to the recess 46, leaving an external portion 47 of the closing end 188 of the retaining element 42 in the access path of the axle 7 of the reel 2.

According to an exemplary embodiment, the foil reel mounting device 40 comprises at least one holding member arranged to move between an unlocked position and a locked position. In the locked position, the holding member cooperates with the retaining element 42 to prevent the pivoting of the retaining element 42 from the intermediate position to the closed position, the holding member being biased towards the unlocked position.

As in the previous embodiment, the external portion 47 of the closing end 188 of the retaining element 42 may be adapted to cooperate with the axle 7 of the reel 2 in the intermediate position to pivot the retaining element 42 in the open position, disengaging the holding member.

The holding member is biased towards the unlocked position, for example by gravity or by spring loading.

In this second embodiment, the holding member is a pin 55 sliding in an opening 56 of the support 41 and arranged to move between an unlocked position and a locked position. The opening 56 is vertical and the pin 55 is biased towards the unlocked position downwardly in the opening 56 by gravity.

In the locked position, the sliding pin 55 cooperates with a hook 57 located at an end of an additional cam surface 58 of the retaining element 42 to prevent pivoting of the retaining element 42 in the closed position. The additional cam surface 58 is formed on the side of the arm of the retaining element 42.

Furthermore, the sliding pin 55 cooperates with the additional cam surface 58 of loop-shape to disengage the sliding pin 55 of the hook 57 when the retaining element 42 is pivoted in the open position.

In operation, the forklift 200 placed under the foil reel mounting device 40 begins to raise the reel 2 vertically.

The axle 7 of the reel 2 pushes against the bottom of the ramp of the cam surface 222 of the retaining element 42, raising the retaining element 42 toward the open position gradually while the axle 7 progresses along the ramp, opening at the same time the access to the recess 46.

The forklift 200 then performs a slight longitudinal movement (to the left in FIG. 14) so that the axle 7 of the reel 2 engages in the recess 46 and rolls therein.

Once the axle 7 of the reel 2 enters the recess 46, the axle 7 of the reel 2 disengages from the cam surface 222 of the retaining element 42. The retaining element 42 which is no longer retained by the axle 7 of the reel 2, rotates to the closed position under the effect of gravity, blocking the access into the recess 46, retaining the axle 7 of the reel 2 in the recess 46.

The forklift 200 can thus be moved away. The reel 2 supported by the bearing of the recess 46 is then in the working position and can be unwound for the stamping operation.

At the end of the operation, when the operator wishes to unload the reel 2, he sets the forklift 200 under the reel 2 and manually raises the retaining element 42 in the intermediate position, partially releasing the access path of the axle 7, partially obstructed by the external portion 47 of the closing end 188.

Then, the operator raises the pin 55, sliding it in the opening 56 to catch it in the hook 57 supported by the retaining element 42. In this locked position, the sliding pin 55 prevents the rotation of the retaining element 42 in the closed position.

The tilting of the retaining element 42 and the sliding of the pin 55 both require manual interventions of the operator.

Then, the reel 2 is moved on the forklift 200. The axle 7 of the reel 2 then pushes the external portion 47 of the closing end 188, turning the retaining element 42 to the open position. This pivoting of the retaining element 42 releases the pin 55 from the hook 57 which falls by gravity into the unlocked position downwardly.

The retaining element 42 which is no longer retained by the pin 55 pivots in the closed position.

Figure 17:
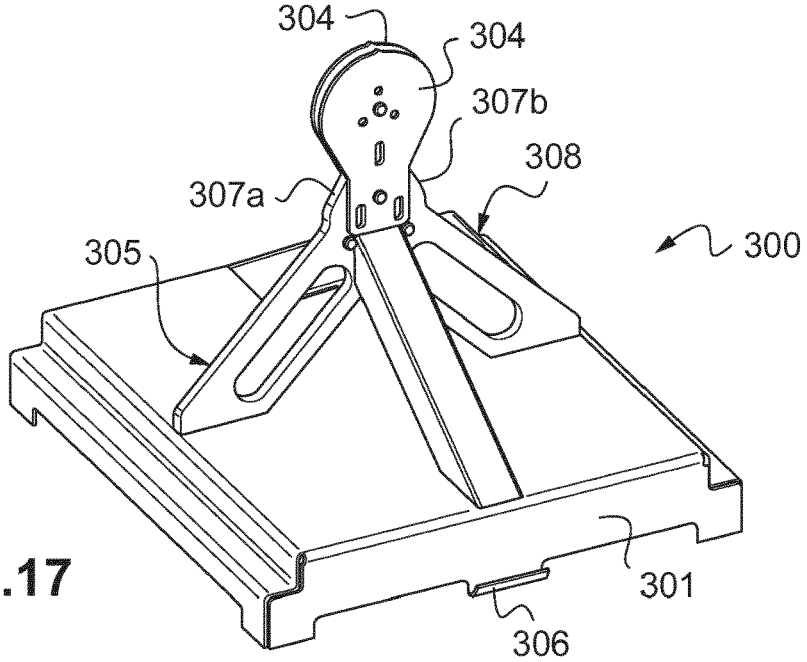
FIG. 17 shows a perspective view of the handling tool of FIG. 16.
Figure 18:
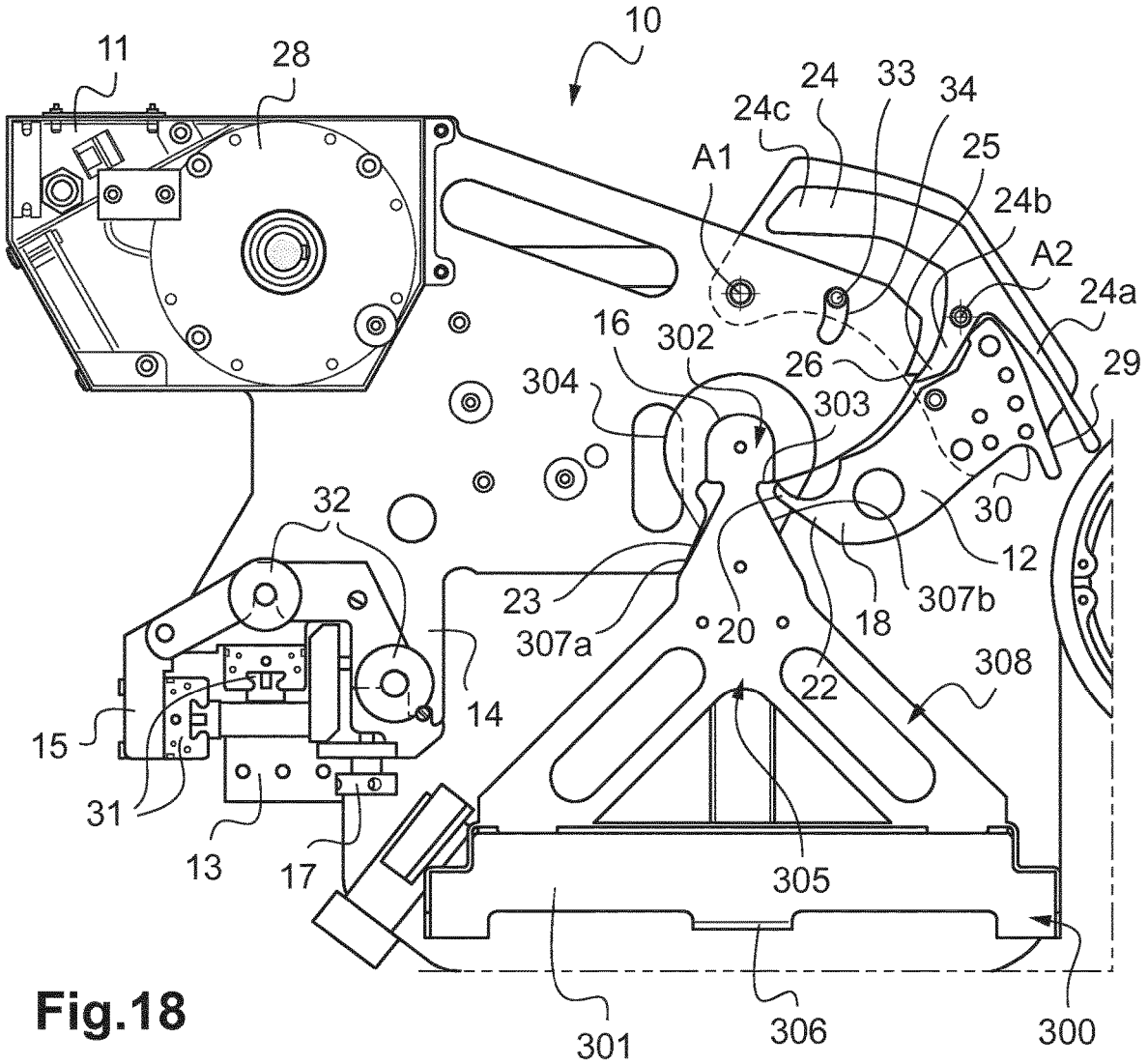
FIG. 18 is a similar view to FIG. 16, with the retaining element in open position and the handling tool engaged in the recess of the foil reel mounting device.

FIGS. 17 and 18 shows a handling tool 300 adapted to carrying a foil reel mounting device 10.

The handling tool 300 comprises a base 301 configured to be mounted on a lifting element of the external lifting means 200, instead of the reel holder.

This base 301 may present approximately the same surface as the reel holder, while presenting a square or parallelepiped shape, enabling a better stability. The base 301 may have fixing elements configured to cooperate with complementary fixing elements of the lifting element. For example, the base 301 comprises two longitudinal hooks 306, arranged on two opposite sides of the parallelepiped shape.

Once equipped with the handling tool 300, the external lifting means 200 may transport a foil reel mounting device 10 to introduce it to or to dismantle it from the supporting module 1. To this end, the handling tool 300 comprises a head 302 configured to be received in the recess 16 of the support 11 of the foil reel mounting device 10 (FIG. 17).

The head 302 has an upper part with a semi-cylindrical shape, complementary to the semi-cylindrical shape of the top of the recess 16. The upper part is thus configured to be in abutment in the top of the recess 16 when the head 302 is engaged in the support 11.

The head 302 also has a retaining hollow 303 in a lower part, configured to cooperate with the external portion 20 of the closing end 18 of the retaining element 12 in an intermediate position to retain the head 302 in the recess 16.

Between the upper part and the retaining hollow 303, the head 302 may present a parallelepiped shape, complementary to the bottom shape of the recess 16. This parallelepiped shape acts as an anti-rotational means of the handling tool 300.

The handling tool 300 may also comprise two lateral flanges 304, with the head 302 sandwiched between them in the transverse direction T. The lateral flanges 304 block the transverse displacement of the head 302 and guide the head 302 in the foil reel mounting device 10.

The handling tool 300 may comprise a trunk part 305 connecting the head 302 to the base 301. The trunk part 305 may comprise a narrow part 307 and an enlarged part 308.

The narrow part 307, nearer the head 302, may present a ramp able to cooperate with the guide wall 23 of the support 11 in the intermediate position so that the handling tool 300 could not rotate when it is engaged in the support 11.

The enlarged part 307 may comprise legs, such as three legs arranged in a pyramidal shape.

In operation, the foil reel mounting device 10 to be dismantled is initially in the closed position, without a reel.

To dismantle it from the supporting module 1, instead of the reel holder, the handling tool 300 is mounted on the lifting element of the external lifting means 200.

Then the external lifting means 200 equipped with the handling tool 300 is placed under the foil reel mounting device 10 and is raised vertically. The head 302 is guided in the foil reel mounting device 10 by the two lateral flanges 304.

The semi-cylindrical shape of the head 302 pushes against the bottom of the ramp of the cam surface 22 of the retaining element 12, raising up the retaining element 12 toward the open position gradually, while the head 302 progresses along the ramp, releasing at the same time the access to the recess 16. The moving of the head 302 against the retaining element 12 pivots the retaining element 12 in the open position.

Figure 16:
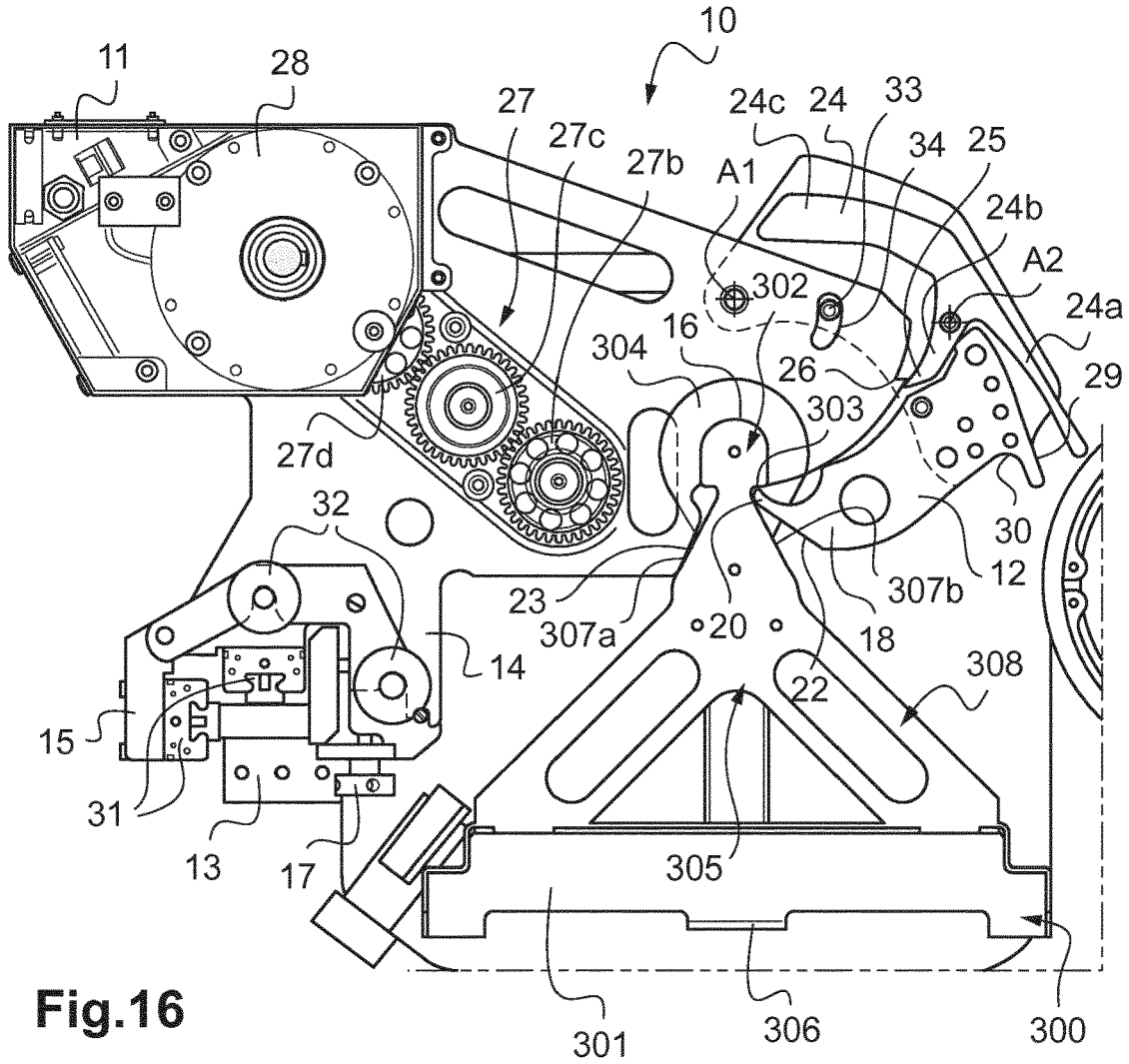
FIG. 16 shows a schematic side view of another example of a foil reel mounting device, mounted on a cross-member, in cross-section, with the retaining element in an intermediate position and with a handling tool engaged in the recess of the foil reel mounting device.

Once the head 302 enters into the recess 16, the upper part of the head 302 disengages from the cam surface 22 of the retaining element 12. The retaining element 12, which is no longer retained, rotates automatically, under the head 302, under the effect of gravity in this example. The external portion 20 of the closing end 18 of retaining element 12 engages the retaining hollow 303, blocking the head 302 in the recess 16 (FIG. 16). The holding lever 24 that was previously in the unlocked position pivots into the locked position wherein the beak 25 of the holding lever 24 engages the catch 26 of the support 11.

Then, the operator disconnects the support 11 of the bracket 15 of the supporting module 1 in this example by unscrewing two screws 32 which hold the base 14 to the bracket 15.

The external lifting means 200 can thus transport the foil reel mounting device 10 out of the supporting module 1, for example by first rolling it in the transverse direction, along the slides 31.

The retaining element 12 has thus been automatically opened by the handling tool 300 and, has been automatically pivoted in an intermediate position to retain the head 302 of the handling tool 300. The foil reel mounting device 10 is thus positioned safely on the handling tool 300 because of the blocking by the retaining element 12 and because it cannot rotate thanks to the anti-rotational means of the handling tool 300. Especially, the ramp of the narrow part 307, enables the handling tool 300 disconnected from the support 11 to not rotate by gravity due to its high weight. The entire foil reel mounting device 10 can thus be dismantled easily by the operator despite its high weight, and without any risks for the operator.

To mount a foil reel mounting device 10 in the supporting module 1, the external lifting means 200 supporting a foil reel mounting device 10, transports it in the transverse direction in the supporting module 1, along the slides 31.

After having connecting the support 11 to the supporting module 1, here by screwing the two screws 32, the operator manually pivots the retaining element 12 in the open position and the holding lever 24 is the unlocked position (FIG. 18), freeing the access to the recess 16, for example until a pin 33 of the retaining element 12 abuts a slotted hole 34 of the support 11.

While the operator maintains the retaining element 12 and the holding lever 24 up, he drops the external lifting means 200. Once the head 302 of the handling tool 300 is moved out of the recess 16, the retaining element 12 pivots in the closing position, the foil reel mounting device 10 being ready to receive a reel 2.

The invention claimed is:

1. A foil reel mounting device configured to support a reel of a foil in a supporting module, the reel of foil having an axle, and the mounting device configured to be fixed to the supporting module and comprising:

a support having a recess with an access to the recess positioned on a bottom of the recess and the recess configured to receive the axle of the reel;

a retaining element mounted on the support, the retaining element being configured to move between:

a closed position in which the retaining element is configured to retain the axle of the reel in the recess by supporting a weight of the reel, and an open position in which the retaining element is configured to release the axle of the reel from the recess, wherein the retaining element is biased towards the closed position.

2. The foil reel mounting device according to claim 1, wherein the retaining element comprises a cam surface located and configured to cooperate with the axle of the reel to facilitate entry of the axle of the reel up into the recess by the axle of the reel displacing the retaining element from the closed position to the open position.

3. The foil reel mounting device according claim 2, wherein the cam surface presents a general shape of a ramp.

4. The foil reel mounting device according to claim 1, wherein the retaining element comprises a lever pivotally mounted on the support.

5. The foil reel mounting device according to claim 1, wherein the retaining element is biased towards the closed position by gravity acting on the retaining element.

6. The foil reel mounting device according to claim 4, wherein the retaining element has a general shape of "C" including a closing end of the C shape configured for obstructing the access to the recess in the closed position, wherein the retaining element has a rotation axis thereof disposed in an opposite end of the retaining element.

7. The foil reel mounting device according to claim 1, further comprising a bearing configured to support the axle of the reel, wherein the bearing is formed in a closing end of the retaining element and is configured to close the recess in the closed position.

8. The foil reel mounting device according to claim 1, further comprising at least one holding member movable between an unlocked position and a locked position, wherein the holding member cooperates with the retaining element to prevent movement of the retaining element to the closed position, and the holding member being biased towards the unlocked position.

9. The foil reel mounting device according to claim 8, wherein the retaining element has an intermediate position between the open position and the closed position, wherein the retaining element releases partially the access to the recess, such that when the retaining element is in the intermediate position, this leaves an extremal portion of the closing end of the retaining element in an access path of the axle of the reel, wherein an extremal portion of the closing end of the retaining element is configured to cooperate with the axle of the reel in the intermediate position to move the retaining element in the open position, disengaging the holding member.

10. The foil reel mounting device according to claim 8, wherein the holding member is biased towards the closed position by gravity.

11. The foil reel mounting device according to claim 8, wherein the holding member comprises a holding lever pivotally mounted on the retaining element and arranged to move between an unlocked position and a locked position.

12. The foil reel mounting device according to claim 11, wherein the holding lever has a first arm in contact with a complementary surface of the retaining element in the locked position.

13. The foil reel mounting device according to claim 12, wherein the retaining element has a clearance configured to allow an operator to pinch manually the end of the first arm against a complementary surface of the retaining element.

14. The foil reel mounting device according to claim 12, wherein the holding lever has a second arm carrying a beak configured to cooperate with a catch of the support in the locked position.

15. The foil reel mounting device according to claim 8, wherein the holding member comprises a pin configured for sliding in an opening of the support and arranged to move between an unlocked position and a locked position, wherein the sliding pin cooperates with a hook of an additional cam surface of the retaining element in the locked position.

16. The foil reel mounting device according to claim 8, further comprising at least one reel rotation brake configured to cooperate with a complementary brake supported by the reel.

17. The foil reel mounting device according to claim 16, wherein the brake comprises an electromagnetic brake.

18. The foil reel mounting device according claim 17, wherein the electromagnetic brake comprises a gear train comprising a first gear secured to a flange of the reel and coaxially to the axle of the reel and a last gear cooperating with an electromagnetic element.

19. The reel mounting device according to claim 1, wherein the supporting module configured to support at least one reel of foil, and the supporting module comprises at least one cross-member on which at least one of the reel mounting devices is mounted.

20. A stamping machine comprising at least one foil reel mounting device according to claim 1.

* * * * *